United States Patent [19]

Creffield et al.

[11] 4,278,737

[45] Jul. 14, 1981

[54] ANODIZING ALUMINUM

[75] Inventors: Geoffrey K. Creffield, Chessington; Anthony J. Wickens, Rudgwick; Anthony C. H. Dowd, Chessington; Vernon F. F. Henley, London, all of England

[73] Assignee: United States Borax & Chemical Corporation, Los Angeles, Calif.

[21] Appl. No.: 62,146

[22] Filed: Jul. 30, 1979

[30] Foreign Application Priority Data

Aug. 4, 1978 [GB] United Kingdom ..... 32277/78

[51] Int. Cl.[3] ..... C25D 11/06

[52] U.S. Cl. ..... 428/469; 204/58

[58] Field of Search ..... 204/58, 38 A; 428/469

[56] References Cited

U.S. PATENT DOCUMENTS

| | | | |
|---|---|---|---|
| 2,019,994 | 11/1935 | Rhodes | 204/58 X |
| 2,073,060 | 3/1937 | Harding et al. | 204/58 X |
| 2,122,392 | 6/1938 | Robinson et al. | 204/58 X |

FOREIGN PATENT DOCUMENTS

| | | |
|---|---|---|
| 2651648 | 12/1977 | Fed. Rep. of Germany . |
| 2331630 | 6/1977 | France . |
| 624449 | 6/1949 | United Kingdom . |
| 644887 | 10/1950 | United Kingdom . |
| 940974 | 11/1963 | United Kingdom . |
| 1121241 | 7/1968 | United Kingdom . |
| 1276745 | 6/1972 | United Kingdom . |
| 1523030 | 8/1978 | United Kingdom . |

OTHER PUBLICATIONS

J. E. Lilienfeld et al., —Formation of Highly Insulating Anodic Layers on Aluminum Electrochemical Society Preprint 68-5, 1935.

*Primary Examiner*—Delbert E. Gantz
*Assistant Examiner*—William Leader
*Attorney, Agent, or Firm*—James R. Thornton

[57] ABSTRACT

Method of anodizing aluminum by subjecting it to electrolysis, first in a bath of electrolyte containing a borate and then in a bath of electrolyte containing an acid. Preferably, the electrolyte in the first bath is about 3-5% borax with the pH adjusted to about 9 to 11 by addition of sodium hydroxide.

The method forms an oxide coating which is of sufficient depth to comply with normal specifications and which also does not suffer from alkaline staining.

12 Claims, No Drawings

ANODIZING ALUMINUM

This invention relates to anodised aluminum. In one aspect, the invention provides a novel method of anodising aluminum which gives an oxide coating having improved properties, and in a second aspect, the invention provides a method for improving the properties of aluminum anodised in conventional acid electrolytes. In a third aspect, the invention provides an aluminum article having an anodic coating of novel construction which has improved properties. In this Specification, the term "aluminum" is intended to include aluminum alloys as well as pure aluminum.

BACKGROUND OF THE INVENTION

The conventional method of anodising aluminum to achieve the characteristic properties and appearance on the surface of the metal is to make the aluminum article the anode in an electrolytic bath having sulphuric acid as electrolyte, for example at a concentration of about 16% by weight of acid in water, and pass an electric current between the cathode and the anodic workpiece. By anodising aluminum in this way, oxide coatings of sufficient thickness to satisfy specifications for the use of aluminum in external architectural constructions are readily achieved. However, anodised surfaces prepared by the sulphuric acid route suffer from the disadvantage that they are susceptible to attack by alkaline media which stain the surface over a short period of time. It is therefore necessary in the building industry to protect all anodised aluminum construction, typically door frames, window frames and decorative cladding, from contact with alkaline materials, such as wet mortar. At present, the surfaces are usually protected in the United Kingdom by the use of adhesive tape over the significant surfaces, which is a time consuming procedure done by hand. In practice on a building site, the adhesive tapes may peel, leaving exposed surfaces susceptible to staining by any mortar which may fall or splash. Furthermore, after the building is completed, the protective tape must be removed, but the mortar may still be green and rain will leach alkali which could contact the surface of the anodised aluminum and cause staining.

Alternative proposals for protecting anodised surfaces have included lacquering followed by baking and the use of air drying lacquers or waxed coatings, but these techniques have not been considered favorably in the United Kingdom. In some instances these coatings interfere with the adhesion to the anodised surface of the mastic compounds used in the building industry.

Other techniques for anodising aluminum have been proposed using alkaline electrolytes. British Pat. No. 1,243,741 discloses the use of alkaline solutions of alkali metal or ammonium borate as electrolytes. Coatings were obtained which had similar properties to anodic coatings of similar thickness produced by conventional sulphuric acid processes, but processes using alkaline electrolytes have not been acceptable for external architectural work in general as it has not been possible hitherto to produce anodic coatings of sufficient thickness. For example, British Standard BS3987: 1974 states that an anodic coating of a thickness of at least 25 μm is required on the surface of aluminum for external architectural use. It has not been found to be practicable to form coatings approaching this value using alkaline electrolytes.

It is therefore desirable to have external architecture manufactured from anodised aluminum with the property of being resistant to attack from alkaline media which would render the use of adhesive tape and other protective devices unnecessary for this purpose.

Thus, an object of the present invention is to provide a method of anodising aluminum so as to form thereon an oxide coating which is of sufficient thickness to comply with normal specifications for external architectural use and which is also more resistant to staining by alkaline media.

A second object of the invention is to provide a more stain resistant anodised aluminum article which retains the desirable properties of aluminum anodised by any of the conventional acid processes.

DESCRIPTION OF THE INVENTION

According to the present invention, there is provided a method of anodising aluminum which comprises subjecting it to electrolysis first in a bath of electrolyte containing an aqueous soluble borate and then in a bath of a conventional electrolyte containing, for example, sulphuric acid. The electrolyte in the first bath is preferably an alkali metal borate, such as sodium borate or borax, at a concentration of around 3 to 5% by weight of the electrolytic solution. It is necessary to adjust the pH of the first bath within the range 9–11, preferably 9.2 to 10.5, and this can be achieved by addition of a suitable alkali, for example sodium hydroxide solution, to the first bath until the pH attains the desired alkalinity. Electrolysis in the first, borate, bath is generally carried out at an elevated temperature such as in the range of about 50°–80° C., preferably about 60°–70° C., and is continued until the depth of the oxide coating formed on the aluminum is at least about 2 microns and preferably between 5 and 10 microns.

The first anodising process can be carried out over a wide range of operating conditions. Both alternating and direct current may be used, or A.C. superimposed on D.C. may be employed. The voltage can range between about 20 and about 75 volts. We have found that particularly suitable conditions are application of a D.C. voltage of about 25–40 volts, especially about 30 to 40 volts, with a 5% by weight borax electrolyte at a pH of 9.5–10 and a temperature of 60°–70° C.

The electrolyte used for the second step in the process of this invention can be, for example, a conventional electrolyte well-known to the art such as sulphuric acid in a concentration of about 16% by weight.

After anodising in borate electrolyte, the aluminum article may be directly placed in the bath containing the sulphuric acid as the presence of small amounts of borate do not appear to be detrimental to the second anodising process. However, on a continuous basis, it may be desirable to rinse the aluminum article after the first anodising stage. This may be effected using water, dilute aqueous sulphuric acid solution (5% or 6% by volume $H_2SO_4$) or a solution based on the second electrolyte.

At a constant working voltage it is necessary to start the second anodising stage at an initial higher voltage than that used in the first stage, to continue anodising. However, by reducing the voltage applied towards the end of the first stage, we have found that the second starting voltage need not exceed the working voltage of the first stage. In practice, this can be effected by stepwise reduction or by continual reduction of voltage to zero over a short period of time.

In the process of this invention, the anodising in the second (acid) bath should be continued until the desired total thickness of the oxide coating on the aluminum article is attained. In the United Kingdom this is 25 microns for external architectural use. Thus, there is also provided by this invention an anodised aluminum article having an oxide coating of which the inner portion approximate the aluminum surface is of the type deposited from a sulphuric acid bath while the outer portion is of the type deposited from a borate bath. The outer portion is preferably at least a thickness of 2 microns after the acid portion has been deposited beneath it. We have found that anodised layers having a thickness of 25 microns are readily achieved using the process of the invention. We also found that the anodised surface showed a great improvement with regard to resistance to attack by alkaline media than surfaces prepared by conventional sulphuric acid processes.

As mentioned in the foregoing, the invention is suitable for anodising both pure aluminum articles and articles of aluminum alloys. In the building industry, the majority of aluminum articles fabricated for external architecture are manufactured from the aluminum alloy H9 (AA6063) which typically contains about 0.5% silicon and 0.5% magnesium.

The invention will be further illustrated by reference to the following examples.

Before anodising, all aluminum samples were cleaned, etched and desmutted using conventional methods.

EXAMPLE 1

A sheet of H9 aluminum alloy was immersed in an electrolytic cell wherein an aqueous solution containing 5% borax adjusted to pH 9.5 with sodium hydroxide was the electrolyte, and as anode was subjected to an electric current density of 20 m.a. $cm^{-2}$ for 30 minutes at 28 volts at 70° C. This formed an oxide coating about 6 microns thick on the surface of the aluminum. The partly anodised article was then rinsed with dilute aqueous sulphuric acid. The rinsed aluminum article was then placed in an electrolytic cell containing 16% by weight aqueous sulphuric acid as electrolyte and anodised at 18° C. and 18 volts for 30 minutes. It was necessary to initially raise the voltage to 36 V to recommence anodising. The anodised product was sealed by immersing in boiling distilled water for one hour. The alloy sheet had an oxide coating about 25 microns thick. The coating had a similar appearance to anodised aluminum produced by the conventional sulphuric acid process.

EXAMPLE 2

An article of aluminum alloy (H9) was anodised first in a 5% solution of borax to which had been added enough sodium hydroxide to increase the pH of the solution to 9.8 at 70° C. Anodising was carried out at 28 volts with an initial current density of 15 m.a. $cm^{-2}$ for 35 minutes. At the end of this time, the anodising current was switched off. The sample was removed from the borax electrolyte, rinsed in 5% $H_2SO_4$ and then transferred to the second anodising bath containing 16% by wt. $H_2SO_4$ at 19° C. The voltage of the second bath was initially raised to 40 volts to cause the anodising current to flow, then this was reduced to 18 volts which was maintained for 15 minutes. At the end of this period, the anodising current was switched off, the sample was removed and rinsed in cold water. The anodic layer was sealed by placing the sample in boiling water for 55 minutes. The thickness of the anodic layer was measured and found to be 20 microns.

EXAMPLE 3

An article of aluminum alloy (H9) was anodised first in a 5% solution of borax to which had been added enough sodium hydroxide to increase the pH of the solution to 9.5 at 70° C. Anodising was carried out at 30 volts with an initial current density of 16 m.a. $cm^{-2}$ for 25 minutes. At the end of this time, the voltage was reduced smoothly to zero over a period of one minute. The sample was removed from the borax electrolyte, rinsed in 5% $H_2SO_4$ and then transferred to the second anodising bath containing 16% by wt. $H_2SO_4$ at 18° C. The voltage of the second bath was raised to 18 volts and anodising was continued for 30 minutes. At the end of this period the anodising current was switched off, the sample was removed and rinsed in cold water. The anodic layer was sealed by placing the sample in boiling water for 60 minutes. The thickness of the anodic layer was measured and found to be 28 microns.

EXAMPLE 4

A section of aluminum alloy (H9) was anodised first in a solution containing 5% borax plus sodium hydroxide to adjust the pH to 9.5 at 70° C. Anodising was carried out for 30 minutes at 30 volts with an initial current density of 12.2 m.a. $cm^{-2}$. After 30 minutes the voltage was reduced to 15 volts over a period of 30 seconds. It was then held at 15 volts for a further 30 seconds. The current was then switched off and the sample removed from the borax anodising bath. It was rinsed in water, then transferred immediately to the second anodising bath containing 10% (v/v)$H_2SO_4$ at 18° C. Anodising was then recommenced by raising the voltage to 18 volts giving a current density of 16.5 m.a. $cm^{-2}$. This second anodising stage was continued for 25 minutes after which time the current was switched off and the sample removed. The sample was rinsed in cold water and then the anodic layer was sealed in the usual way by immersing it in boiling water for 55 minutes. The combined borax plus $H_2SO_4$ produced anodic layer was 19 microns thick.

EXAMPLE 5

A section of aluminum alloy (H9) was anodised first in a solution containing 5% borax plus sodium hydroxide to adjust the pH to 9.5 at 70° C. Anodising was carried out for 40 minutes at 30 volts with an initial current density of 13 m.a. $cm^{-2}$. After 40 minutes, the voltage was reduced to 15 volts over a period of 30 seconds. It was then held at 15 volts for a further 30 seconds. The current was switched off and the sample removed from the borax anodising bath. It was rinsed in water, then transferred immediately to the second anodising bath containing 10% (v/v)$H_2SO_4$ at 18° C. Anodising was then recommenced by raising the voltage to 18 volts, giving a current density of 16.5 m.a. $cm^{-2}$. This second anodising stage was continued for 30 minutes, after which time the current was switched off and the sample removed. The sample was rinsed in cold water and then the anodic layer was sealed in the usual way by immersing it in boiling water for 60 minutes. The combined borax plus $H_2SO_4$ produced anodic layer was 25 microns thick.

EXAMPLE 6

To simulate conditions where the samples were placed in the second anodising bath without rinsing, the procedure according to Example 5 was followed except that 5% by volume of the borate electrolyte was added to the second anodising bath. An anodised layer of 23μ was produced.

EXAMPLE 7

A sheet of aluminum alloy NS 41 (0.5–1.2% Mg, 0.4% Si, 0.5% Mn, 0.2% Cu, 0.7% Fe) (also sold as AA5005) was anodised according to the procedure described in Example 1 but at a pH of 9.25 in the first stage. The anodised layer had similar properties to that produced on H9 alloys.

EXAMPLE 8

A section of aluminum alloy (H9) was anodised first in a solution containing 5% borax plus sodium hydroxide to adjust the pH to 9.5 at 70° C. Anodising was carried out for 30 minutes at 30 volts with an initial current density of 11 m.a. $cm^{-2}$. After 30 minutes, the voltage was gradually reduced to zero over a period of 1 minute. The sample was then removed from the borax anodising bath and rinsed in a solution containing sulphosalicylic acid (50 g/l) and sulphuric acid (2.5 g/l). The sample was transferred to the second anodising bath containing sulphosalicylic acid (65 g/l); sulphuric acid (5 g/l) and aluminum (1.7 g/l) at 21° C. Anodising was recommended by raising the voltage to 35 v, giving a current density of 27 m.a. $cm^{-2}$. The second anodising stage was continued for 25 minutes during which time the voltage was steadily increased to 50 volts. At the end of this period, the current was switched off, the sample was removed and rinsed in cold water. The anodic layer was sealed by immersing in boiling water for 60 minutes. The anodised sample was an attractive bronze color with a total anodic layer thickness of 22 microns.

It is important that the borax is not dissolved in water carrying large amounts of dissolved calcium and/or magnesium salts since these ions are known to inhibit the dissolution of aluminum in borate solutions which will prevent the formation of thick, porous anodic layers. In hard water areas, the problem may be overcome by the dilution of tap water with distilled water or by the addition of complexing agents such as the disodium salt of ethylene-diamine tetracetic acid (EDTA).

It is very important that the anodic layers according to the invention can be properly sealed since this will affect corrosion resistance, color retention and general appearance. British Standard BS 3987: 1974 describes therein a test for quality of sealing which involves measuring the weight loss after immersion in a standard solution of chromic acid/phosphoric acid at 38° C. The anodic layers produced according to the invention meet the requirements of this specification.

To demonstrate the resistance to alkali of articles anodised by the process of the invention, a spot test was carried out in which sodium hydroxide (2 and 5% solutions) was applied to small areas of the anodised surface of aluminum and of H9. After five minutes, the surfaces were washed with water and examined. The anodised layer formed by the process of the invention showed no signs of staining. Commercially available samples of aluminum and its alloys anodised by conventional methods using sulphuric acid showed obvious and pronounced severe staining when subjected to the same treatment. Similar tests in which the sodium hydroxide solution was replaced by a typical mortar composition were carried out, the mortar being left on the surface for one hour before washing. Samples anodised by the process of this invention showed no staining whereas samples anodised by the conventional process were very badly stained.

Table 1 indicates typical results obtained when comparing the effect of placing drops of dilute sodium hydroxide on the surface of articles of H9 alloy anodised by the process of the invention and a conventional process.

TABLE 1

| Electrolyte | Anodic Thickness (μm) | Alkali Test dil. NaOH (5 Minutes) 1% | 2.5% | 5% |
|---|---|---|---|---|
| $H_2SO_4$ (comparative) | 15 | 5 | 5 | 5 |
| $H_2SO_4$ (comparative) | 26 | 5 | 5 | 5 |
| Borax + $H_2SO_4$ | 16 (6) | 0 | 0 | 0 |
| Borax + $H_2SO_4$ | 25 (7.5) | 0 | 0 | 0 |

The arbitrary scale 0–5 indicates the degree of staining where 0=no stain and 5=heavy stain.

The anodic thickness in parentheses indicate the thickness of the anodic layer after the first stage. They do not indicate the thickness of the borate portion of the final layer as the figures do not take into account the solvent action of the sulphuric acid electrolyte during the second stage.

To simulate a real situation, further tests were carried out to study the resistance of the anodised layer to staining by wet mortar. Two mortar compositions were used which comprised 6 parts sand to 1 part Portland cement to 1 part lime and 3 parts sand to 1 part Portland cement. Pats of mortar were applied to anodised samples prepared using the process conditions given in Table 2. In some cases, the mortar was allowed to dry, but in others, it was washed off and replaced with more fresh wet mortar after intervals of about 1 hour up to a maximum of 7 hours. The results obtained are given in Table 3.

TABLE 2

| Ex. | Electrolyte | Temp. (°C.) | pH | Time (min.) | Working Voltage | Current Density m.a. $cm^{-2}$ | Total Anodic Thickness (μ) |
|---|---|---|---|---|---|---|---|
| 9 | $H_2SO_4$ | 20 | — | 20 | 20 | 40 | 28 |
| 10 | $H_2SO_4$ | 19 | — | 20 | 20 | 30 | 22 |
| 11 | $H_2SO_4$ | 18 | — | 25 | 18 | 20 | 20 |
| 12 | Borax | 70 | 9.5 | 15 | 30 | 17 | 26 (4.5) |
| | $H_2SO_4$ | 21 | — | 30 | 18 | 24 | |
| 13 | Borax | 70 | 9.5 | 25 | 30 | 12 | 16 (6) |
| | $H_2SO_4$ | 20 | — | 16 | 18 | 22 | |
| 14 | Borax | 70 | 9.7 | 40 | 28 | 10 | 23 |
| | $H_2SO_4$ | 18 | — | 25 | 18 | 18 | |
| 15 | Borax | 70 | 9.5 | 25 | 29 | 14 | 16 (5) |
| | $H_2SO_4$ | 21 | — | 20 | 19 | 20 | |

TABLE 3

| Example | Electrolyte | Anodic Thickness (μm) | Sand-Cement-Lime 6:1:1 Wet | Sand-Cement-Lime 6:1:1 Dried | Sand-Cement 3:1 Wet | Sand-Cement 3:1 Dried |
|---|---|---|---|---|---|---|
| — | $H_2SO_4$ (comparative) (commercial) | 14 | 4 | 4 | 4 | 4 |
| 9 | $H_2SO_4$ (comparative) | 28 | 5 | 5 | 5 | 5 |
| 10 | $H_2SO_4$ (comparative) | 22 | 5 | 5 | 4 | 4 |
| 11 | $H_2SO_4$ (comparative) | 20 | 5 | 5 | 4 | 4 |
| 12 | Borax + $H_2SO_4$ | 26 (4.5) | 0 | 1 | 0 | 1 |
| 13 | Borax + $H_2SO_4$ | 16 (6) | 0 | 1 | 0 | 0 |
| 14 | Borax + $H_2SO_4$ | 23 | 0 | 1 | 1 | 0 |
| 15 | Borax + $H_2SO_4$ | 16 (5) | 0 | 1 | 0 | 0 |

In general, it was observed that mortar which had been allowed to dry was strongly adhered to the surface of anodised samples prepared using the sulphuric acid process and the mortar could easily be removed with a wet cloth from the surfaces prepared according to this invention. Tests carried out with regard to hardness, acetic acid salt spray corrosion resistance, durability, etc. of the anodised layers prepared according to this invention gave results which were never inferior to those produced on samples prepared using a conventional sulphuric acid process.

Various changes and modifications of the invention can be made, and to the extent that such variations incorporate the spirit of this invention, they are intended to be included within the scope of the appended claims.

What is claimed is:

1. A method of anodising aluminum which comprises subjecting it to electrolysis first in a bath of an aqueous alkaline electrolyte solution containing a borate at a pH of between 9 and 11 and a temperature in the range of about 50° to 80° C. until there is formed an oxide layer at least 2 microns thick and then in a second bath of electrolyte containing an aqueous solution of an acid until the desired total thickness of the oxide coating is formed.

2. A method according to claim 1 in which said borate is borax.

3. A method according to claim 2 in which after being anodised in the first bath, the aluminum article is rinsed in a dilute aqueous acid before being anodised in the second bath.

4. A method according to claim 1 in which the alkaline electrolyte solution contains about 3 to 5% by weight of borax.

5. A method according to claim 1 in which alkali is included in the first bath sufficient to adjust the pH to 9.2 to 10.5.

6. A method according to claim 1 in which said first electrolysis is with about 30 to 40 volts D.C.

7. A method according to claim 1 in which said first electrolysis is at a bath temperature of about 60°–70° C.

8. A method according to claim 1 in which the electrolyte of the second bath is an aqueous solution containing sulfuric acid.

9. A method according to claim 1 in which the resultant outer portion of the oxide layer is about 2 to 10 microns thick and the total thickness is about 25 microns.

10. A method according to claim 1 in which the solution of the first bath contains 5% by weight borax adjusted to a pH of about 9.2 to 10.5 and the anodisation takes place at a temperature of 60°–70° C. and D.C. voltage of about 30–40 volts.

11. A method according to claim 10 in which the second bath is an aqueous solution containing about 16% by weight sulfuric acid.

12. An anodised aluminum article having an oxide coating produced by the method of claim 1.

* * * * *